US009958817B2

(12) United States Patent
Handa

(10) Patent No.: US 9,958,817 B2
(45) Date of Patent: May 1, 2018

(54) FIXING DEVICE

(71) Applicant: Brother Kogyo Kabushiki Kaisha, Nagoya-shi, Aichi-ken (JP)

(72) Inventor: Hiroshi Handa, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/223,535

(22) Filed: Jul. 29, 2016

(65) Prior Publication Data

US 2017/0031277 A1 Feb. 2, 2017

(30) Foreign Application Priority Data

Jul. 29, 2015 (JP) ..... 2015-149290

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2007; G03G 15/2053; G03G 2215/2035
See application file for complete search history.

(56) References Cited

U.S. PATENT DOCUMENTS 8,489,007 B2 7/2013 Fujiwara et al.
8,559,860 B2 10/2013 Ishigaya et al.
8,682,237 B2 3/2014 Ishigaya et al.
2004/0037573 A1* 2/2004 Hirota ..... G03G 15/0121 399/12
2009/0016776 A1* 1/2009 Priebe ..... G03G 15/1625 399/231
2009/0154948 A1* 6/2009 Cahill ..... G03G 15/2039 399/69
2010/0086324 A1* 4/2010 Smith ..... G03G 15/2053 399/67
2011/0150543 A1 6/2011 Fujiwara et al.
2011/0158716 A1* 6/2011 Fujiwara ..... G03G 15/2053 399/329
2011/0170920 A1* 7/2011 Fujiwara ..... G03G 15/2064 399/331

(Continued)

FOREIGN PATENT DOCUMENTS

JP 2011-095549 A 5/2011
JP 2011-154076 A 8/2011

*Primary Examiner* — David Bolduc
(74) *Attorney, Agent, or Firm* — Banner & Witcoff, Ltd.

(57) ABSTRACT

A fixing device includes a film, a first heat element, a second heat element, a nip member, a reflection member and a supporting member, which are disposed inside a loop of the film, and a pressing member. The nip member contacts the inner circumferential surface of the film. The reflection member surrounds the first heat element with the nip member and reflects radiant heat from the first heat element to the nip member. The pressing member presses the film toward the nip member. The supporting member covers the reflection member, supports the nip member, and includes a first plate portion, a second plate portion and a third plate portion. The second heat element is disposed in at least one of the second plate portion, the third plate portion, one end portion of the nip member, and another end portion of the nip member.

17 Claims, 12 Drawing Sheets

(56) References Cited

U.S. PATENT DOCUMENTS

2011/0182634 A1 7/2011 Ishigaya et al.
2011/0206427 A1* 8/2011 Iwaya ..... G03G 15/2053 399/329
2011/0268464 A1* 11/2011 Aslam ..... G03G 15/2007 399/67
2012/0051809 A1* 3/2012 Miyauchi ..... G03G 15/2064 399/329
2012/0275833 A1* 11/2012 Ishida ..... G03G 15/2053 399/329
2012/0308275 A1* 12/2012 Suzuki ..... G03G 15/2017 399/329
2013/0136511 A1* 5/2013 Suzuki ..... G03G 15/2035 399/329
2013/0279955 A1* 10/2013 Maeda ..... G03G 15/2053 399/329
2013/0330111 A1* 12/2013 Tokuda ..... G03G 15/6576 399/329
2014/0010578 A1 1/2014 Ishigaya et al.
2014/0086649 A1* 3/2014 Hazeyama ..... G03G 15/2017 399/329
2014/0212190 A1* 7/2014 Takeuchi ..... G03G 15/2053 399/329
2014/0341627 A1* 11/2014 Yoshikawa ..... G03G 15/2053 399/329
2015/0093166 A1* 4/2015 Ishida ..... G03G 15/2064 399/329
2015/0277315 A1* 10/2015 Maruyama ..... G03G 15/2053 399/329
2016/0187823 A1* 6/2016 Seto ..... G03G 15/2082 399/329
2016/0223963 A1* 8/2016 Yoshinaga ..... G03G 15/2053
2016/0231674 A1* 8/2016 Ishida ..... G03G 15/2053
2016/0231675 A1* 8/2016 Ishida ..... G03G 15/2053
2016/0231676 A1* 8/2016 Ishida ..... G03G 15/2053
2016/0231677 A1* 8/2016 Ishida ..... G03G 15/2053

* cited by examiner

FIXING DEVICE

CROSS-REFERENCE TO RELATED APPLICATION

This application claims priority from Japanese Patent Application No. 2015-149290 filed on Jul. 29, 2015, the content of which is incorporated herein by reference in its entirety.

FIELD OF DISCLOSURE

Aspects of the disclosure relate to a fixing device configured to thermally fix a developer image onto a recording sheet.

BACKGROUND

An electrophotographic image forming apparatus such a laser printer includes a fixing device configured to thermally fix a toner image onto a printing sheet. A known fixing device includes a halogen lamp as a heating element. A nip plate and a fixing film are heated by a radiant heat from the halogen lamp. The printing sheet is passed through between a pressure roller and the heated fixing film. Thus, the toner image is thermally fixed on the printing sheet.

SUMMARY

In such a fixing device, the halogen lamp is turned off under standby condition that a printing process is not executed. Then, when a printing instruction is input into the image forming apparatus, the fixing device is activated and the halogen lamp is turned on. After the halogen lamp is turned on, it is difficult to execute the fixing process on the printing sheet until a temperature of the fixing film rises to a fixable temperature.

Recently, it is strongly required to reduce the time to complete printing after the printing instruction is input into the image forming apparatus, i.e. First Print Output Time (FPOT). Accordingly, it is also required to reduce a heat up time of the fixing film in the fixing device. However, it is difficult to heat up the fixing film to the fixable temperature quickly only by the radiant heat of the halogen lamp.

It is an object of the present invention to provide a fixing device which can reduce the time for the film to rise to the fixable temperature from the start of heating.

According to an aspect of the disclosure, a fixing device includes a film, a first heat element, a second heat element, a nip member, a reflection member, a pressing member, and a supporting member. The film may have a cylindrical shape extending in a first direction. The first heat element may be disposed inside a loop of the film and extend in the first direction. The second heat element may be different from the first heat element. The nip member may extend in the first direction between an inner circumferential surface of the film and the first heat element and may be configured to contact the inner circumferential surface of the film. The reflection member may be disposed inside the loop of the film and extend in the first direction. The reflection member may be configured to surround the first heat element with the nip member and reflect a radiant heat from the first heat element to the nip member. The pressing member may be disposed outside the loop of the film and configured to press the film toward the nip member. The supporting member may be disposed inside the loop of the film and extend in the first direction. The supporting member may be configured to cover the reflection member and support the nip member. The supporting member may include a first plate portion, a second plate portion, and a third plate portion. The first plate portion may extend along the first direction and face the nip member via the first heat element in a second direction different from the first direction. The second plate portion and the third plate portion may extend along the first direction and face each other via the first heat element in a third direction different from the first direction and the second direction. The second heat element may be disposed in at least one of the second plate portion, the third plate portion, one end portion of the nip member in the third direction, and another end portion of the nip member in the third direction.

DETAILED DESCRIPTION

A preferred embodiment of the disclosure will be described with reference to the following drawings.

1. Overall Configuration of Image Forming Apparatus

Figure 1:
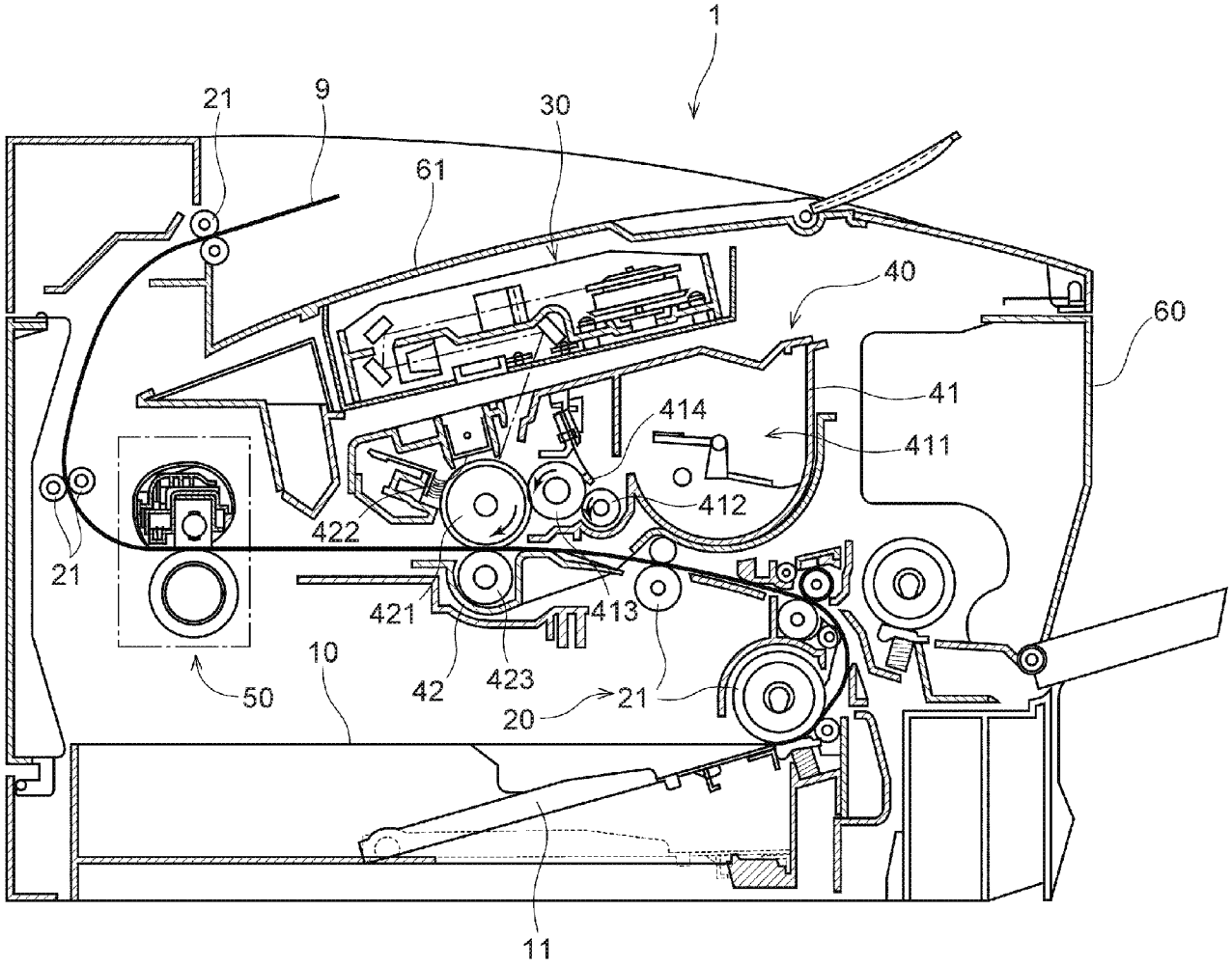
FIG. 1 is a sectional view of the image forming apparatus.

FIG. 1 is a sectional view of an image forming apparatus 1 including a fixing device 50 according to an illustrative embodiment. This image forming apparatus is an electrophotographic printer (laser printer). The image forming apparatus 1 records an image on a surface of a printing sheet 9 as a recording sheet. As illustrated in FIG. 1, the image forming apparatus 1 includes a sheet supply tray 10, a conveyance mechanism 20, an exposure portion 30, a process cartridge 40, and a fixing device 50. These are accommodated inside a casing 60.

The sheet supply tray 10 is a tray to accommodate the printing sheet 9 to be printed. The sheet supply tray 10 is disposed at a most upstream side of a sheet feed passage of the printing sheet 9 in the casing 60. Before executing a printing process, a plurality of printing sheets 9 is stacked inside the sheet supply tray 10. When the sheet supply tray 10 on which the plurality of printing sheets 9 are stacked is placed in the casing 60, a pressing plate 11 including the sheet supply tray 10 presses the plurality of printing sheets 9 inside the sheet supply tray 10 toward a feed roller 21. Thus, the plurality of printing sheets 9 inside the sheet supply tray 10 moves closer to the feed roller 21. Then, one of the plurality of printing sheets 9, which is closest to the feed roller 21, makes a contact with the feed roller 21.

The conveyance mechanism 20 is a mechanism for feeding the printing sheet 9 from the sheet supply tray 10 to an ejection tray 61. The conveyance mechanism 20 includes a plurality of feed rollers 21. During operation of the image forming apparatus 1, each of the plurality of feed rollers 21 rotates about a horizontal axis. The plurality of printing sheets 9 are fed one by one along a sheet feed passage defined by the plurality of feed rollers 21 while contacting the plurality of feed rollers 21 during rotating sequentially.

The exposure portion 30 is a mechanism for exposing a photosensitive drum 421 inside the process cartridge 40. The exposure portion 30 is disposed between the process cartridge 40 and the ejection tray 61, for example. The exposure portion 30 switches a laser oscillator on and off based on an image data to be printed. Laser beam emitted from the laser oscillator is deflected by an optical system composed of such as polygon mirror. Thus, the exposure portion 30 exposes an outer peripheral surface of the photosensitive drum 421 while scanning at high speed by the laser beam. As a result, a latent static image corresponding to the image data is formed on the outer peripheral surface of the photosensitive drum 421.

The process cartridge 40 has a mechanism for transferring a toner image on a recording surface of the printing sheet 9. The process cartridge 40 is detachably disposed between the sheet feed passage of the printing sheet 9 and the exposure portion 30. A user of the image forming apparatus 1 may be able to open a front cover of the casing 60 and attach the process cartridge 40 to the image forming apparatus 1 and detach the process cartridge 40 from the image forming apparatus 1. The process cartridge 40 in the embodiment includes a developing unit 41 and a drum unit 42. The developing unit 41 is detachably attachable to the drum unit 42. Thus, the user of the image forming apparatus 1 may be able to detach only the developing unit 41 from the process cartridge 40 and replace it with a new developing unit 41.

The developing unit 41 includes a toner storing portion 411, a supply roller 412, a developing roller 413, and a layer thickness regulating blade 414. A toner as a developer is supplied from the toner storing portion 411 via the supply roller 412 to the developing roller 413. On this occasion, the toner is charged between the supply roller 412 and the developing roller 413 by friction. The layer thickness regulating blade 414 chips off excess toner supplied on the outer peripheral surface of the developing roller 413. Thus, the toner is carried at a constant thickness on the surface of the developing roller 413 which passed through the layer thickness regulating blade 414.

The drum unit 42 includes a photosensitive drum 421, a charger 422, and a transfer roller 423. A surface of the photosensitive drum 421 is uniformly charged by the charger 422 and then receives irradiation of the laser beam from the exposure portion 30. Thus, a latent static image is formed on the outer peripheral surface of the photosensitive drum 421. The toner carried on the outer peripheral surface of the developing roller 413 is supplied from the developing roller 413 to the photosensitive drum 421 in accordance with the latent static image formed on the outer peripheral surface of the photosensitive drum 421. As a result, a toner image is formed on the outer peripheral surface of the photosensitive drum 421. Then, the printing sheet 9 passes through between the photosensitive drum 421 and the transfer roller 423, and thus the toner image is transferred on the recording surface of the printing sheet 9 from the outer peripheral surface of the photosensitive drum 421.

The fixing device 50 is a device configured to thermally fix a toner image on a recording surface of the printing sheet 9. The fixing device 50 is disposed, on the sheet feed passage of the printing sheet 9, at a downstream side of the process cartridge 40 in a sheet feed direction and an upstream side of the ejection tray 61 in the sheet feed direction. When the printing sheet 9 passes through the fixing device 50, the toner image on the printing sheet 9 receives heat and pressure from the fixing device 50. Thus, the toner image is fixed on the recording surface of the printing sheet 9. Then, the printing sheet 9 is ejected onto the ejection tray 61 by the plurality of feed rollers 21 of the conveyance mechanism 20.

The fixing device 50 will be described in detail later.

2. Configuration of Control System

Figure 2:
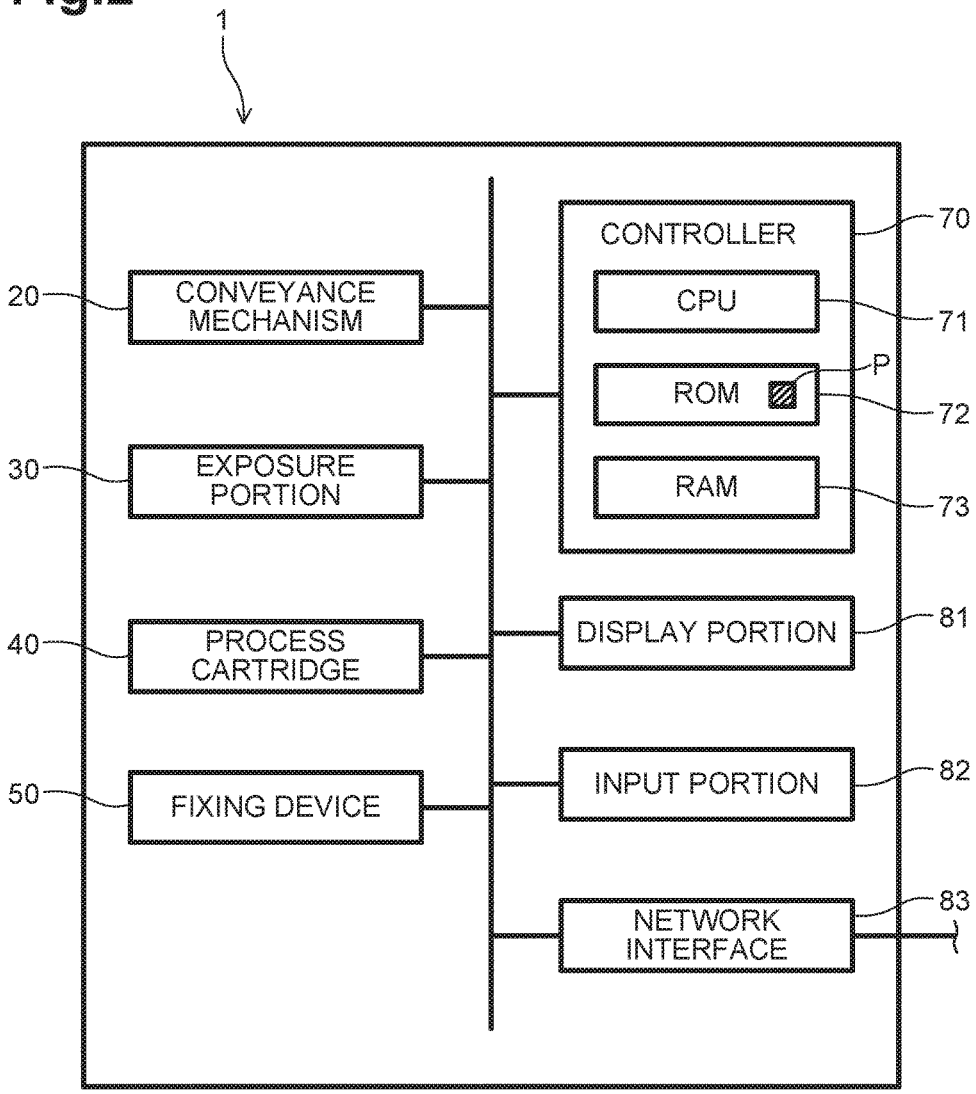
FIG. 2 is a block diagram conceptually illustrating a configuration of control system of the image forming apparatus.

A control system for controlling each of portions inside the image forming apparatus 1 electrically will be described. FIG. 2 is a block diagram conceptually illustrating a configuration of the control system. As illustrated in FIG. 2, the image forming apparatus 1 includes a controller 70, a display portion 81, an input portion 82, and a network interface 83. The conveyance mechanism 20, the exposure portion 30, the process cartridge 40, and the fixing device 50 are mutually connected to communicate with the controller 70, the display portion 81, the input portion 82, and the network interface 83.

The controller 70 includes CPU 71, ROM 72, and RAM 73, for example. ROM 72 stores a program P for controlling operation of the image forming apparatus 1. The controller 70 controls operations of the conveyance mechanism 20, the exposure portion 30, the process cartridge 40, and the fixing device 50, by following the program P retrieved from ROM 72 and executing calculation of CPU 71. On this occasion, data generated with calculation of CPU 71 is temporarily stored in RAM 73.

The display portion 81 displays information needed for operating the image forming apparatus 1, an operating status of the image forming apparatus 1, and so on. A liquid crystal display is used as the display portion 81, for example. The input portion 82 has a plurality of operation buttons. A user of the image forming apparatus 1 may be able to input various commands such as an execution of a printing process to the controller 70 by operating the input portion 82 while confirming the information displayed on the display portion 81. The network interface 83 is connected to an outside information terminal via a wired or wireless communication means. The user may be also able to input various commands such as an execution of a printing process to the controller 70 via the network interface 83.

3. Structure of Fixing Device

The structure of the fixing device 50 will be described.

Figure 3:
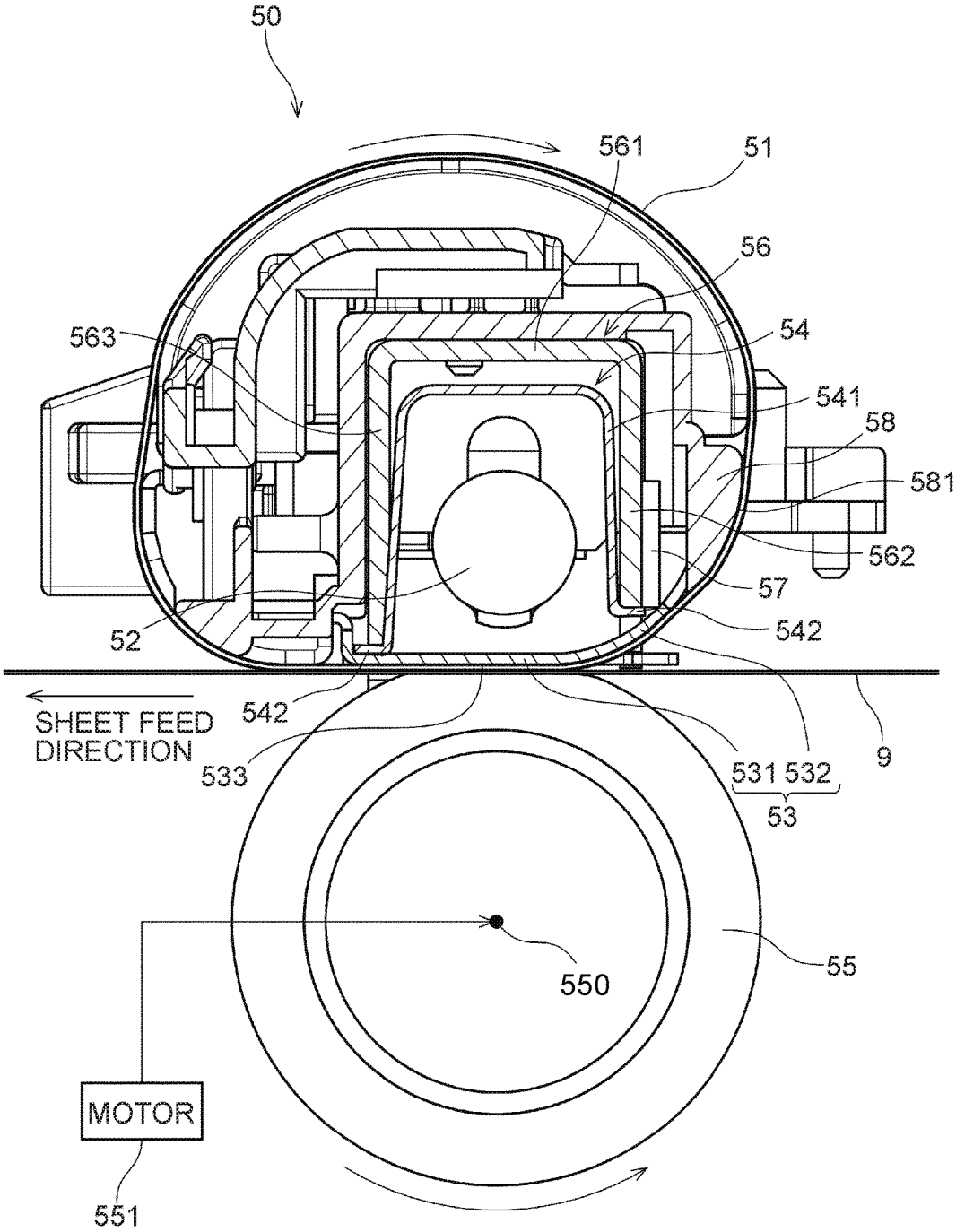
FIG. 3 is a longitudinal sectional view of the fixing device.
Figure 4:
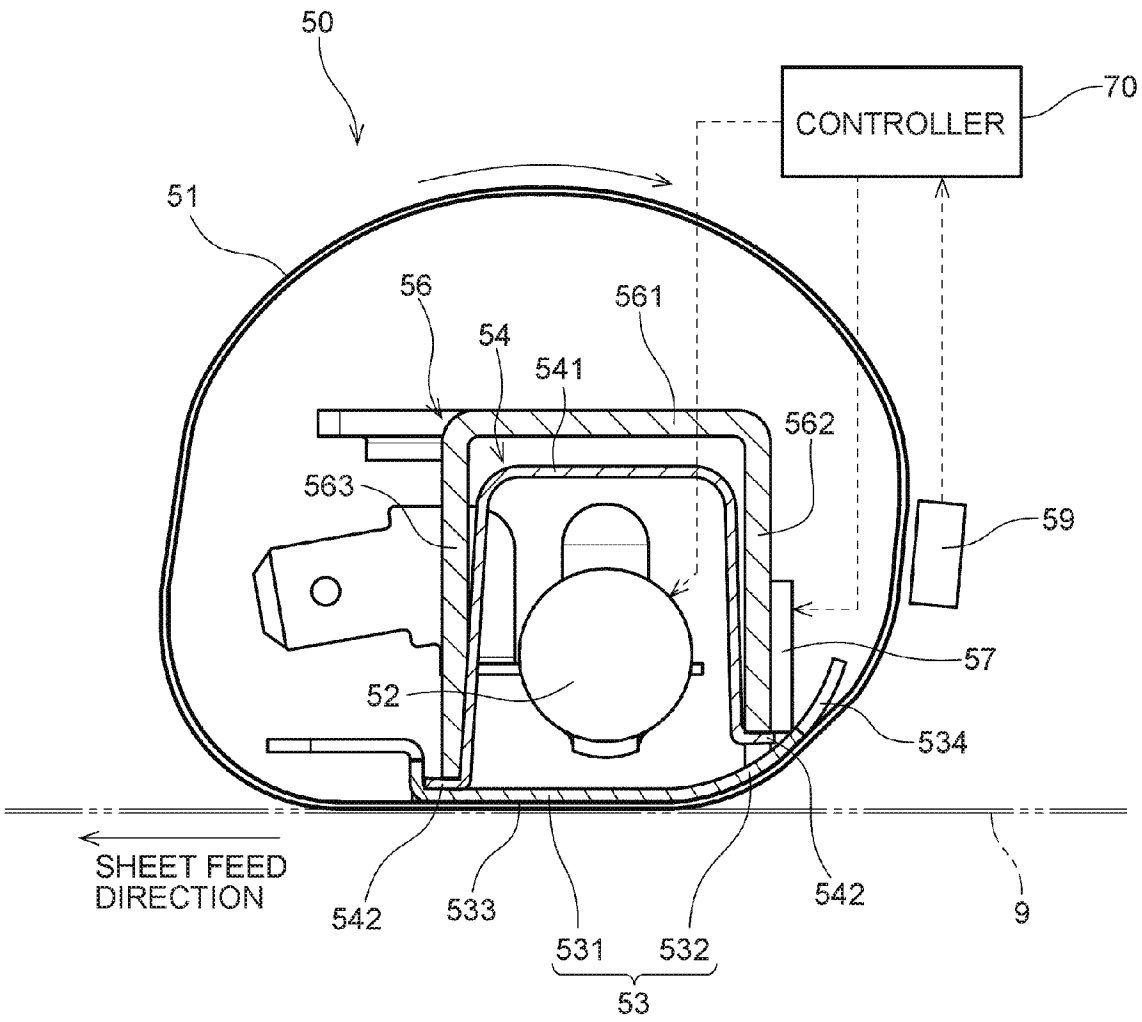
FIG. 4 is a longitudinal sectional view of the fixing device.
Figure 5:
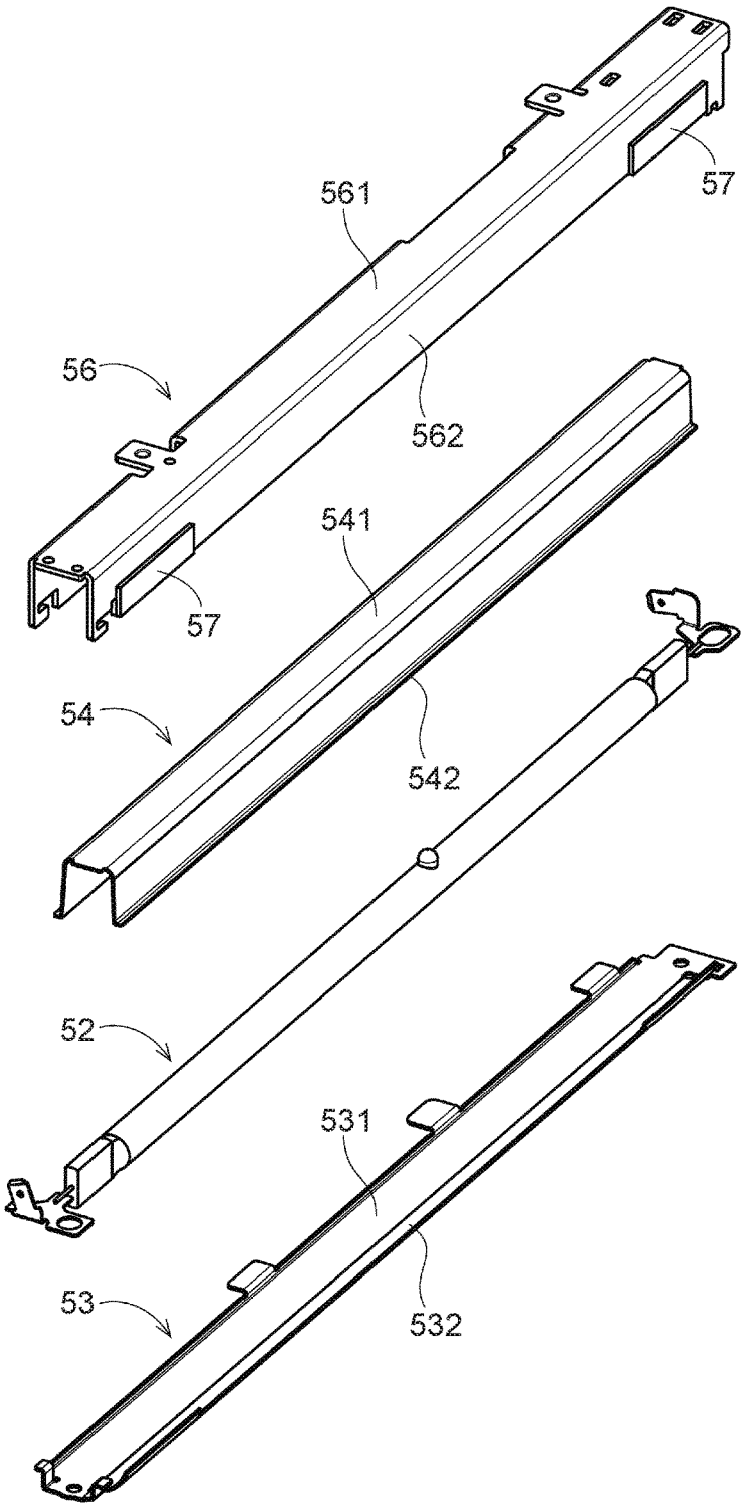
FIG. 5 is an exploded perspective view of a first heating element, a nip member, a reflection member and a supporting member.

FIGS. 3 and 4 are longitudinal sectional views of the fixing device 50. Some members are not shown in FIG. 4, to facilitate understanding. As illustrated in FIGS. 3 and 4, the fixing device 50 includes a film 51, a first heating element 52, a nip member 53, a reflection member 54 (as an example of a partition), a pressing member 55, a supporting member 56 (as an example of a partition), a second heating element 57, a guide member 58, and a temperature sensor 59. FIG. 5 is an exploded perspective view of the first heating element 52, the nip member 53, the reflection member 54 and the supporting member 56. The following description will be made with reference to FIGS. 3 and 4, and FIG. 5 as needed.

The film 51 is a cylindrical member having heat resistance and flexibility. Metal such as a stainless is used as a material of the film 51. Resin such as a polyimide is also used as a material of the film 51. In the following description, a direction in which the film 51 has a cylindrical shape extending refers to a first direction. In this embodiment, a direction perpendicular to and horizontal to the sheet feed direction of the printing direction 9 is the first direction. An inner circumferential surface of the film 51 contacts at least the nip member 53 and the guide member 58. The film 51 is supported rotatably around a first axis along the first direction.

The first heat element 52 is a heat source configured to generate a radiant heat by an electric current. The first heat element 52 is positioned inside a loop of the film 51 and has a solid cylindrical shape extending along the first direction. The first heat element 52 is also positioned between the nip member 53 and the reflection member 54, and disposed inside the reflection member 54. A halogen lamp is used as the first heat element 52, for example. The first heat element 52 is electrically connected to the controller 70, and put the light on or off according to an instruction of the controller 70.

The nip member 53 is a plate-like member. The nip member 53 extends in the first direction between the inner circumferential surface of the film 51 and the first heat element 52. One surface of the nip member 53 contacts the inner circumferential surface of the film 51. Metal such as an aluminum having high thermal conductivity is used as a material of the nip member 53. During operation of the fixing device 50, the nip member 53 is heated by a radiant heat from the first heat element 52. Then, the heat of the nip member 53 is conducted to the printing sheet 9 via the film 51.

Figure 6:
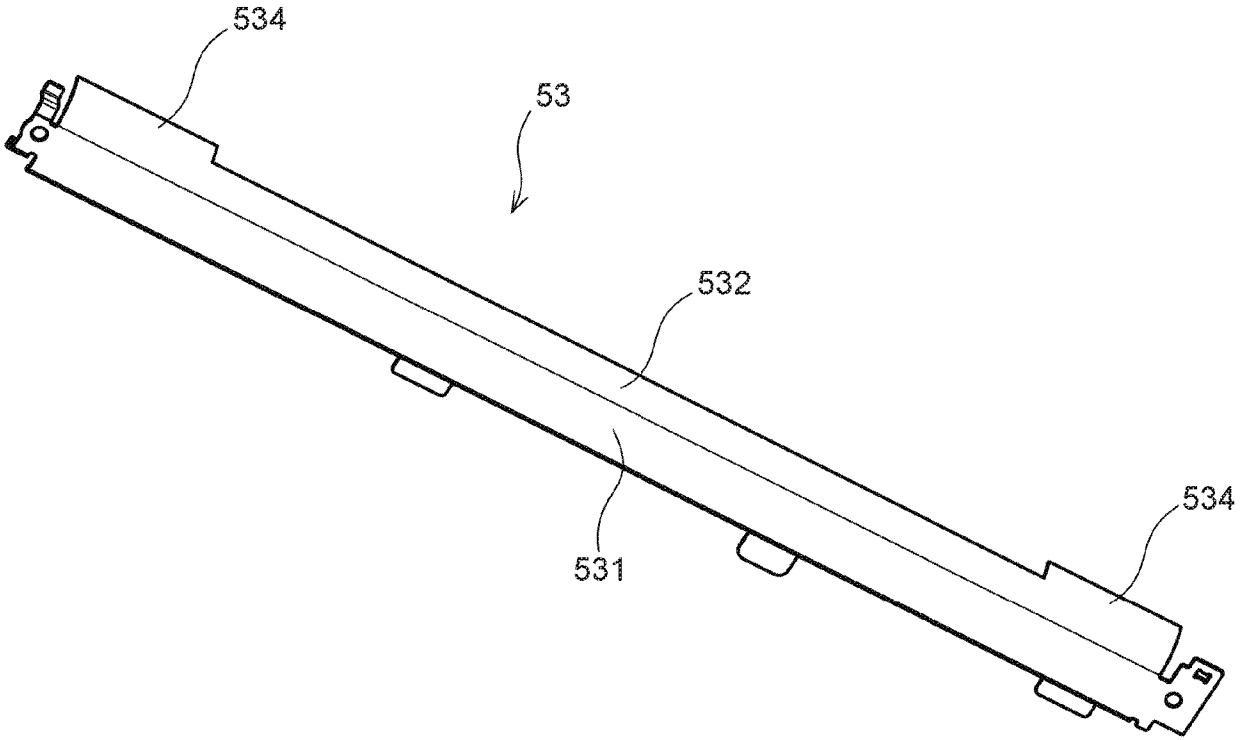
FIG. 6 is a perspective view of the nip member as viewed from a side of a surface to contact the film.

FIG. 6 is a perspective view of the nip member 53 as viewed from a side of a surface to contact the film 51. As illustrated in FIGS. 3 to 6, the nip member 53 in the embodiment has a flat plate portion 531 and an extending portion 532. The flat plate portion 531 is positioned between the first heat element 52 and the pressing member 55. The flat plate portion 531 extends substantially vertically to a plain surface connecting a central axis of the first heat element 52 and a rotation axis of the pressing member 55. One surface of the flat plate portion 531 is a nip surface 533 such that the nip surface 533 and the pressing member 55 sandwich the film 51 therebetween. The extending portion 532 extends toward an upstream side of the film 51 in a rotation direction from the flat plate portion 531 while bending along the inner circumferential surface of the film 51.

As illustrated in FIGS. 4 and 6, the extending portion 532 includes a pair of protruding portion 534. One of the pair of the protruding portion 534 is positioned at one end portion of the extending portion 532 in the first direction. The other of the pair of the protruding portion 534 is positioned at another end portion of the extending portion 532 in the first direction. The pair of protruding portion 534 extends longer than other portions of the extending portion 532 between the film 51 and the supporting member 56. The pair of protruding portion 534 is away from the inner circumferential surface of the film 51 and comes closer to the second heat element 57.

The reflection member 54 is a member configured to reflect a part of the radiant heat from the first heat element 52 to the nip member 53. Metal such as an aluminum having high infrared and far-infrared reflectance is used as a material of the reflection member 54. The reflection member 54 extends in the first direction inside the loop of the film 51. The reflection member 54 includes a cup portion 541, which has a substantially U-shape and opens toward the nip member 53, and a pair of flange portions 542. The pair of flange portions 542 extends from both end portions of the cup portion 541 approaching the nip member 53 in a direction in which the both end portions of the cup portion 541 are away from each other. The first heat element 52 is disposed inside a cylindrical portion consisted of the nip member 53 and the reflection member 54. Namely, the nip member 53 and the reflection member 54 surround the first axis of the first heat element 52.

A part of the radiant heat from the first heat element 52 reaches the nip member 53 directly. Another part of the radiant heat from the first heat element 52 reflects at an inner surface of the reflection member 54 and reaches the nip member 53. By using the reflection member 54, the radiant heat from the first heat element 52 can be irradiated to the nip member 53 via a plurality of passages. Thus, the nip member 53 can be heated efficiently.

The pressing member 55 is a member configured to press the film 51 toward the nip member 53. The pressing member 55 is positioned outside the loop of the film 51. The pressing member 55 is positioned opposite to the first heat element 52 relative to the flat plate portion 531 of the nip member 53. The pressing member 55 in the embodiment is a roller that is supported rotatably around the rotation axis 550 extending in the first direction. An elastic rubber is used as a material of the pressing member 55, for example. The film 51 and the printing sheet 9 are sandwiched between the nip surface 533 of the nip member 53 and the outer peripheral surface of the pressing member 55. The pressing member 55 may be pressed toward the nip member 53 by an urging member such as a spring.

During operation of the fixing device 50, the pressing member 55 rotates around the rotation axis 550 by a power output from a motor 551 conceptually illustrated in FIG. 3. The rotation of the pressing member 55 allows the film 51 to be rotated due to friction between the pressing member 55 and the printing sheet 9. The toner image on the printing sheet 9 receives heat and pressure by passing through between the heated film 51 and the pressing member 55. Thus, the toner image is thermally fixed on the printing sheet 9.

The supporting member 56 is a member configured to support the nip member 53 against the pressure of the pressing member 55. Metal such as an iron having higher stiffness than the nip member 53 is used as a material of the supporting member 56. The supporting member 56 extends in the first direction inside the loop of the film 51. The supporting member 56 extends along the reflection member 54 and has a substantially U-shape opened toward the nip member 53.

The supporting member 56 includes a first plate portion 561, a second plate portion 562, and a third plate portion 563. The first plate portion 561, the second plate portion 562, and the third plate portion 563 extend along the first direction. The first plate portion 561 faces the nip member 53 via the first heat element 52 in a second direction different from the first direction, which is an arrangement direction of the first heat element 52 and the pressing member 55 in the embodiment. The second plate portion 562 and the third plate portion 563 face each other via the first heat element 52 in a third direction different from the first direction and the second direction, which is a direction parallel to the sheet feed direction of the printing sheet 9 in the embodiment. An end surface of the reflection member 54 in the second direction, which is a surface farthest from the nip member 53, is covered by the first plate portion 561 of the supporting member 56. Both side surfaces of the reflection member 54 in the third direction are covered by the second plate portion 562 and the third plate portion 563 of the supporting member 56, respectively.

In this embodiment, each of an end portion, closer to the nip member 53, of the second plate portion 562 and an end portion, closer to the nip member 53, of the third plate portion 563 contacts each of the pair of flange portions 542 of the reflection member 54, respectively. Accordingly, the supporting member 56 supports the nip member 53 via the pair of flange portions 542 of the reflection member 54. However, the end portion, closer to the nip member 53, of the second plate portion 562 and the end portion, closer to the nip member 53, of the third plate portion 563 may directly contact the nip member 53 without the reflection member 54.

The second heat element 57 is a heat source provided separately from the first heat element 52. A plate-like ceramic heater is used as the second heat element 57, for example. As illustrated in FIG. 5, a pair of second heat elements 57 is fixed to the second plate portion 562 of the supporting member 56 in the embodiment. One of the pair of second heat elements 57 is disposed at a position corresponding to one end portion of the first heat element 52 in the first direction. The other of the pair of second heat elements 57 is disposed at a position corresponding to the other end portion of the first heat element 52 in the first direction. For example, each of the pair of second heat elements 57 is disposed in a position in the first direction, overlapping a corresponding end portion, in the first direction, of a surface of the first heat element 52 which generates a radiant heat. An amount of the radiant heat from the first heat element 52 is larger than an amount of the radiant heat from the second heat element 57.

The pair of second heat elements 57 is disposed on the second plate portion 562 of the supporting member 56 in FIG. 5. One second heat element 57 may be disposed on one of the one end portion and the other end portion of the second plate portion 562 in the first direction.

When the electric current to the second heat element 57 is carried, a temperature of the second heat element 57 is raised. Then, the heat is conducted from the second heat element 57 to the film 51 via the supporting member 56, the reflection member 54, and the nip member 53. By the pair of second heat elements 57, the amount of heat to be conducted into the vicinity of both of the end portions of the film 51 in the first direction increases. Thus, the film 51 can be heated more quickly by using the first heat element 52 and the second heat elements 57 together. Accordingly, the time for the film 51 to rise to the fixable temperature from the start of heating can be reduced.

Specifically, heat loss to air is greater in the vicinity of both of the end portions of the film 51 in the first direction than in the vicinity of the central portion of the film 51 in the first direction. In the embodiment, the vicinity of both of the end portions of the film 51 in the first direction where the heat loss is great is mainly heated by the pair of second heat elements 57. Thus, the amount of heat which the film 51 receives from the first heat element 52 and the pair of second heat elements 57 is homogenized in the first direction. Namely, the film 51 is heated homogeneously in the first direction.

In the embodiment, the second heat element 57 is disposed in the end portion, closer to the nip member 53, of the second plate portion 562. Namely, in the supporting member 56, the second heat element 57 is disposed in a position closest to the nip member 53. Thus, the nip member 53 can be heated more quickly in comparison with the case where the second heat element 57 is disposed in other positions of the supporting member 56.

In the embodiment, the second heat element 57 is disposed in the second plate portion 562 positioned upstream of the film 51 in the rotation direction (i.e. the second plate portion 562 close to the extending portion 532), among the second plate portion 562 and the third plate portion 563 of the supporting member 56. Thus, the second heat element 57 mainly heats a portion of the film 51, where is positioned right before entering between the nip member 53 and the pressing member 55. The portion of the film 51 heated by the second heat element 57 enters between the nip member 53 and the pressing member 55 right after heating. Thus, the heat generated from the second heat element 57 can be utilized for the fixing process efficiently.

As illustrated in FIG. 3, the guide member 58 contacts the inner circumferential surface of the film 51 and includes a guide surface 581 configured to guide the film 51 to the nip surface 533. The film 51 is closest to the second heat element 57 at a downstream side of the film 51 in the rotation direction from the guide surface 581 of the guide member 58 and at an upstream side of the film 51 in the rotation direction from the nip surface 533 of the nip member 53. Thus, the second heat element 57 mainly heats a portion of the film 51, where is positioned between the guide surface 581 and the nip surface 533. The portion of the film 51 heated by the second heat element 57 enters between the nip member 53 and the pressing member 55 without contacting the guide member 58 after heating. Thus, the heat given to the second heat element 57 is prevented from transferring to the guide member 58. As a result, the heat generated from the second heat element 57 can be utilized for the fixing process more efficiently.

In the embodiment, the second heat element 57 is disposed outside the supporting member 56. Namely, the second heat element 57 is disposed not on a surface close to the reflection member 54, but on a surface opposite to the surface close to the reflection member 54, of the second plate portion 562. Thus, the radiant heat from the first heat element 52 may not be prevented by the second heat element 57. Accordingly, the film 51 can be heated efficiently by the radiant heat from the first heat element 52 and the heat conducted from the second heat element 57. As a result, the film 51 can be heated more quickly.

Figure 7:
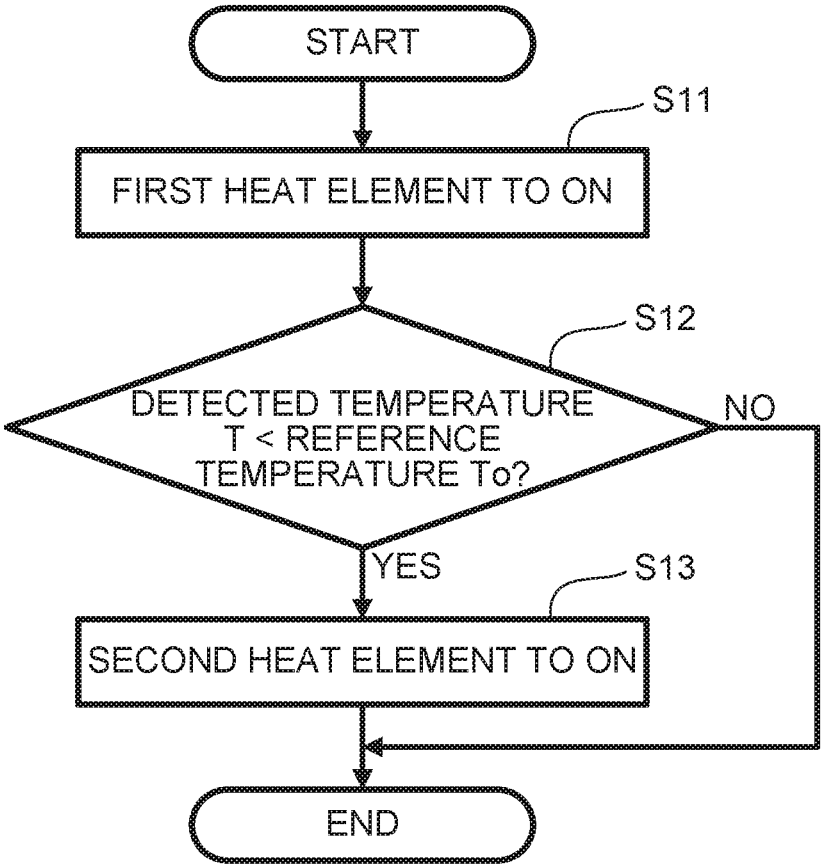
FIG. 7 is a flowchart showing a flow of a thermally-fixing process.

FIG. 7 is a flowchart showing an example of a thermally-fixing process in the fixing device 50. A series of processes shown in FIG. 7 is executed every time the controller 70 instructs the fixing device 50 to execute the thermally-fixing process. As illustrated in FIG. 7, when the thermally-fixing process is executed in the fixing device 50, first, the controller 70 rotates the pressing member 55, and heats the first heat element 52 by the electric current to the first heat element 52 (S11). Next, the controller 70 detects the temperature T of the film 51 by the temperature sensor 59 disposed in the vicinity of the film 51. Then, the controller 70 determines whether the detected temperature T of the film 51 is lower than the preset reference temperature To (S12).

When the temperature T of the film 51 is higher than the reference temperature To (NO at S12), the controller does not heat the second heat element 57 and executes the thermally-fixing process to the target printing sheet 9. On the other hand, when the temperature T of the film 51 is lower than the reference temperature To (YES at S12), the controller heats the second heat element 57 by the electric current to the second heat element 57 (S13). This control allows the second heat element 57 to be heated and the film 51 to be heated supplementarily only when the temperature rise of the film 51 is insufficient, based on the actual measured value of the temperature of the film 51. As a result, the film 51 can be heated up to the fixable temperature quickly.

When the thermally-fixing process is completed, the controller 70 stops the electric current to the first heat element 52. If the controller 70 executes the electric current to the second heat element 57 when the thermally-fixing process is completed, the controller 70 also stops the electric current to the second heat element 57.

In the above embodiment, the pair of second heat elements 57 is disposed on the second plate portion 562 of the supporting member 56. However, the pair of second heat elements 57 may be disposed on the third plate portion 563 of the supporting member 56. Specifically, the pair of second heat elements 57 may be fixed to the third plate portion 563. In this case, one of the pair of second heat elements 57 may be disposed in a position, corresponding to one end portion of the first heat element 52 in the first direction, of the third plate portion 563. The other of the pair of second heat elements 57 may be disposed in a position, corresponding to the other end portion of the first heat element 52 in the first direction, of the third plate portion 563. One second heat element 57 may be disposed on one of the one end portion and the other end portion of the third plate portion 563 in the first direction.

4. Variation

Figure 9:
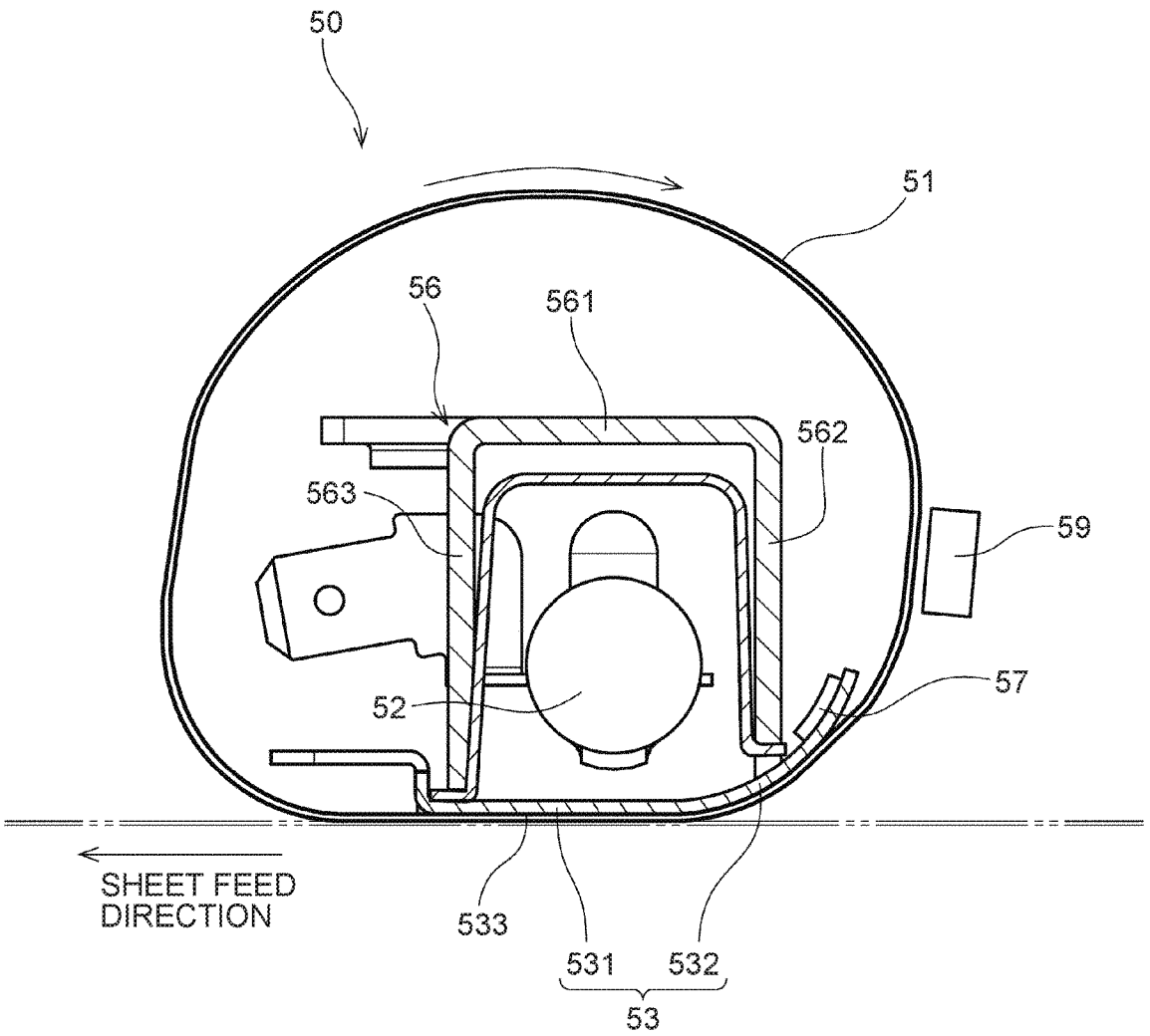
FIG. 9 is a longitudinal sectional view of the fixing device in a variation.
Figure 10:
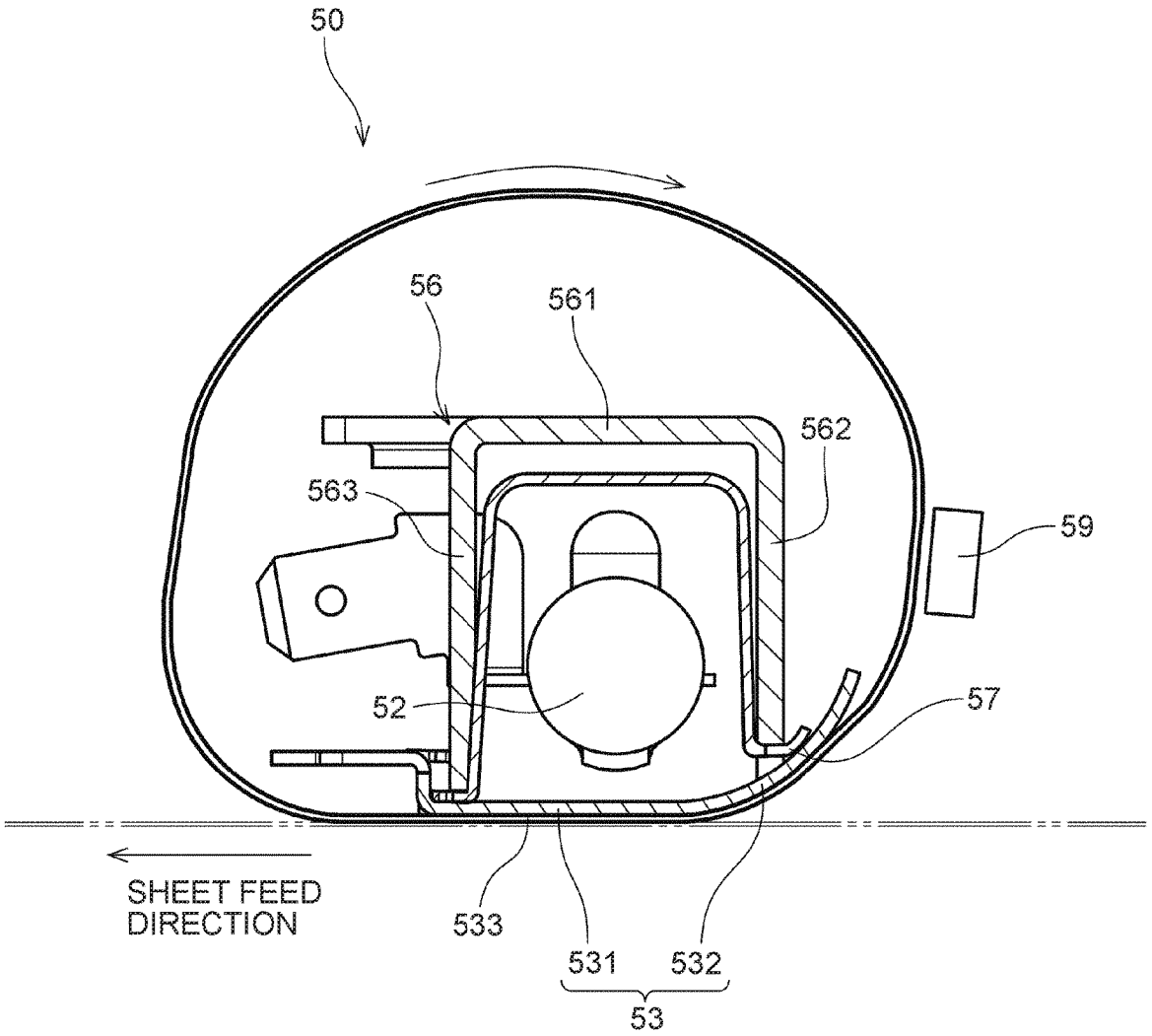
FIG. 10 is a longitudinal sectional view of the fixing device in a variation.
Figure 11:
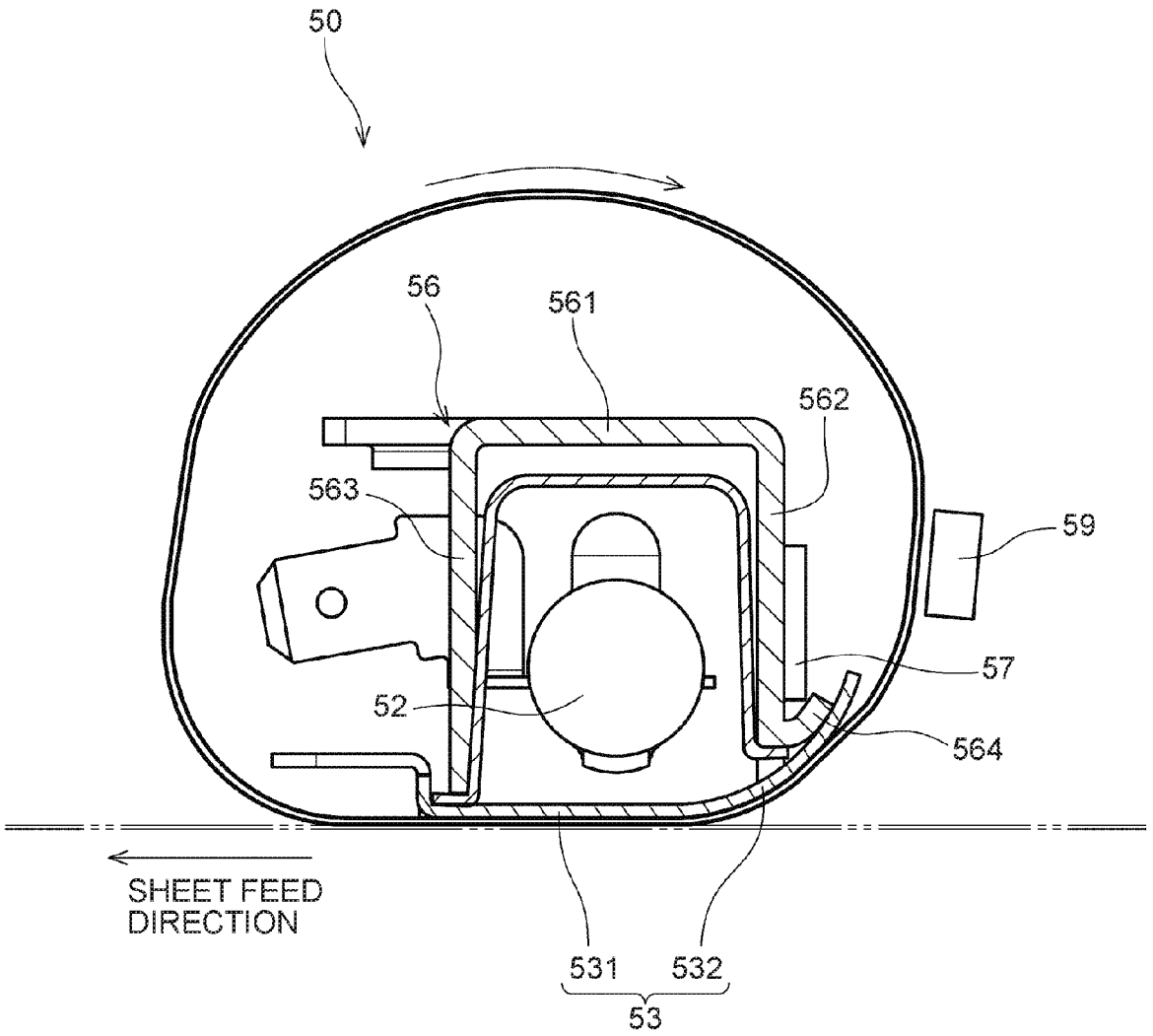
FIG. 11 is a longitudinal sectional view of the fixing device in a variation.

The above has described an embodiment of the present invention, but the present invention is not limited to the above embodiment. Variations of the above embodiment will be described with reference to the FIGS. 8 to 12. In FIGS. 9 to 11, as in FIG. 4, a part of members such as a guide member is not shown.

Figure 8:
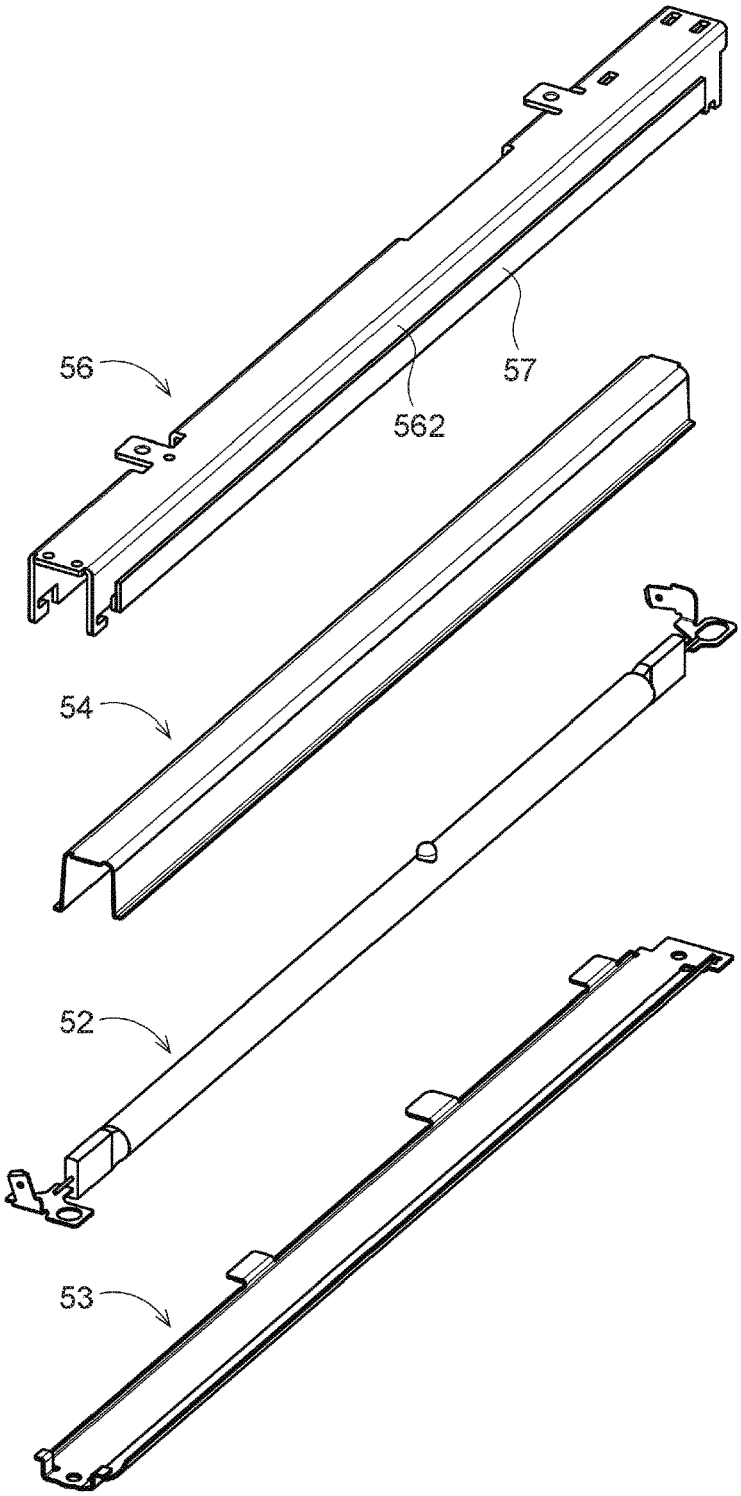
FIG. 8 is an exploded perspective view of a first heating element, a nip member, a reflection member and a supporting member in a variation.

FIG. 8 is an exploded perspective view of the first heating element 52, the nip member 53, the reflection member 54, and the supporting member 56 in a first variation. In the example of FIG. 8, the second heat element 57 is disposed on almost the entire width of the second plate portion 562 of the supporting member 56 in the first direction. Namely, the second heat element 57 of FIG. 8 extends from a position corresponding to one end portion of the first heat element 52 in the first direction to a position corresponding to the other end portion of the first heat element 52 in the first direction. For example, the second heat elements 57 extends in the first direction so as to overlap both one end portion and the other end portion, in the first direction, of a surface of the first heat element 52 which generates a radiant heat. According to this structure, by the second heat element 57, the amount of heat to conduct to the vicinity of the central portion of the film 51 in the first direction can be increased, as well as the amount of heat to conduct to the vicinity of both of the end portions of the film 51 in the first direction.

Namely, the second heat element 57 may be disposed only on the vicinity of both of the end portions of the supporting member 56 in the first direction in the above embodiment, and may be also disposed on almost the entire width of the supporting member 56 in the first direction as illustrated in FIG. 8. However, as described above, in the vicinity of both of the end portions of the film 51 in the first direction, the amount of the radiant heat from the first heat element 52 is small, and heat loss also occurs easily. Thus, in order to quickly raise the temperature in the vicinity of both of the end portions of the film 51 in the first direction, it is preferred that the second heat element 57 is disposed at least in the vicinity of both of the end portions of the supporting member 56 in the first direction.

The second heat element 57 is fixed to the second plate portion 562 in the example of FIG. 8. The second heat element 57 may be fixed to the third plate portion 563.

FIG. 9 is a longitudinal sectional view of the fixing device in a second variation. In the example of FIG. 9, the second heat element 57 is fixed not to the supporting member 56, but to the nip member 53. Specifically, the second heat element 57 is disposed on a surface, close to the supporting member 56, of the extending portion 532 which is positioned in one end portion of the nip member 53 in the third direction. According to this structure, a position of the second heat element 57 gets closer to the film 51 in comparison with the case where the second heat element 57 is fixed to the supporting member 56. Then, a heat-conducting path from the second heat element 57 to the film 51 gets shorter. Thus, by the heat from the second heat element 57, the film 51 can be heated more quickly.

In the example of FIG. 9, one of the pair of second heat elements 57 may be disposed in a position, corresponding to one end portion of the first heat element 52 in the first direction, of the extending portion 532. The other of the pair of second heat elements 57 may be disposed in a position, corresponding to the other end portion of the first heat element 52 in the first direction, of the extending portion 532. However, one second heat element 57 may be disposed on one of the one end portion and the other end portion of the extending portion 532 in the first direction. The extending portion 532 and the second heat element 57 may extend from a position corresponding to one end portion of the first heat element 52 in the first direction to a position corresponding to the other end portion of the first heat element 52 in the first direction.

The second heat element 57 may be disposed on the other end portion of the nip member 53 in the third direction. However, as illustrated in FIG. 9, if the second heat element 57 is disposed in the extending portion 532 which is positioned at an upstream side of the film 51 in the rotation direction from the nip surface 533, the portion of the film 51 heated by the second heat element 57 enters between the nip surface 533 and the pressing member 55 right after heating. Thus, the heat generated from the second heat element 57 can be utilized for the fixing process efficiently.

FIG. 10 is a longitudinal sectional view of the fixing device in a third variation. In the example of FIG. 10, the second heat element 57 is positioned in one end portion of the supporting member 53 in the third direction, and is sandwiched between the supporting member 56 and the nip member 53. Specifically, the second heat element 57 is sandwiched between an end portion, close to the nip member 53, of the second plate portion 562 of the supporting member 56 and a surface, close to the supporting member 56, of the extending portion 532 of the nip member 53. According to this structure, a position of the second heat element 57 gets closer to the nip surface 533 in comparison with the case of FIG. 9. The portion of the film 51 heated by the second heat element 57 enters between the nip surface 533 and the pressing member 55 in a shorter time after heating. Thus, the heat generated from the second heat element 57 can be utilized for the fixing process more efficiently.

In the example of FIG. 10, one of the pair of second heat elements 57 may be disposed in a position, corresponding to one end portion of the first heat element 52 in the first direction. The other of the pair of second heat elements 57 is disposed in a position corresponding to the other end portion of the first heat element 52 in the first direction. However, one second heat element 57 may be disposed on one of the one end portion and the other end portion in the first direction between the supporting member 56 and the nip portion 53. The second heat element 57 may extend from a position corresponding to one end portion of the first heat element 52 in the first direction to a position corresponding to the other end portion of the first heat element 52 in the first direction. The second heat element 57 may be sandwiched between an end portion, close to the nip member 53, of the third plate portion 563 of the supporting member 56 and a surface, close to the supporting member 56, of the nip member 53, on a side closer to the other end portion than the first heat element 52 in the third direction.

As described above, the second heat element 57 may be disposed on at least one of the second plate portion 562 of the supporting member 56, the third plate portion 563 of the supporting member 56, the one end portion of the nip member 53 in the third direction, and the other end portion of the nip member 53 in the third direction. The second heat element 57 may be disposed on two or more of these positions. The second heat element 57 may be additionally disposed on a position different from these positions.

FIG. 11 is a longitudinal sectional view of the fixing device in a fourth variation. In the example of FIG. 11, the second heat element 57 is fixed to the second plate portion 562 of the supporting member 56. The supporting member 56 in FIG. 11 includes a foot portion 564 extending from an end portion, close to the nip member 53, of the second plate portion 562 toward the extending portion 532 of the nip member 53. A surface, close to the supporting member 56, of the extending portion 532 of the nip member 53 directly contacts a surface, close to the nip member 53, of the foot portion 564 of the supporting member 56. According to this structure, the heat can be conducted more easily between the supporting member 56 and the nip member 53. Thus, the heat generated from the second heat element 57 can be more efficiently conducted to the film 51 via the supporting member 56 and the nip member 53.

Figure 12:
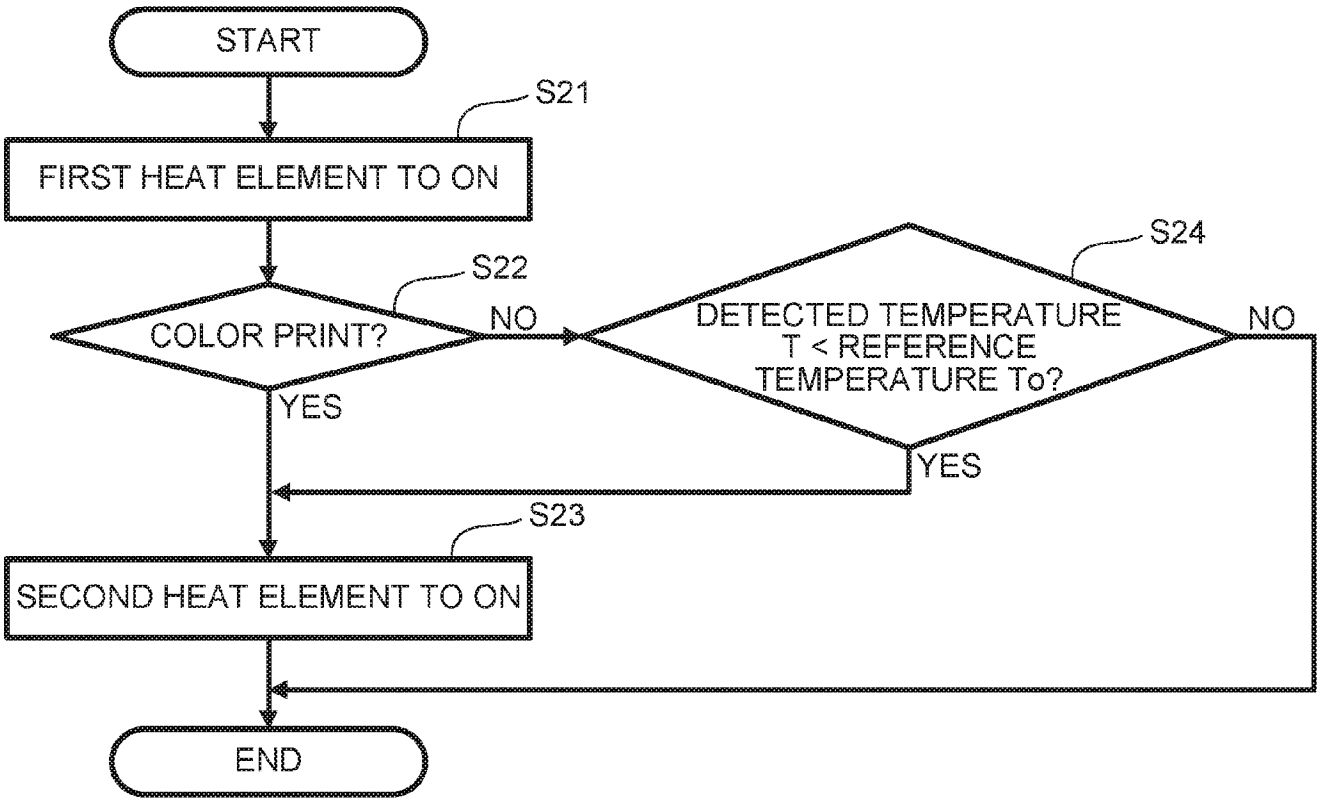
FIG. 12 is a flowchart showing a flow of a thermally-fixing process in a variation.

The image forming apparatus in FIG. 1, which is described in the embodiments, is a monochrome printer. However, the fixing device of the disclosure may be used in a color printer. FIG. 12 is a flowchart showing an example of a thermally-fixing process to be executed in the color printer. A series of processes shown in FIG. 12 is executed every time the controller 70 instructs the fixing device 50 to execute the thermally-fixing process.

In the example of FIG. 12, first, the controller 70 heats the first heat element 52 by the electric current to the first heat element 52 (S21). Next, the controller 70 acquires information indicating the number of colors of developers to be used in printing. Specifically, the controller 70 determines whether the print instruction is a monochrome print or a color print (S22).

When the print instruction is a color print, i.e. when the number of colors of developers to be ejected on the printing sheet 9 is larger than the preset reference value, and when YES at S22, a plurality of monochromatic toner images is transferred over onto the printing sheet 9. Thus, it is necessary to raise the temperature of the film 51 in the fixing device 50. In this case, the controller 70 heats the second heat element 57 by the electric current to the second heat element 57 (S23).

On the other hand, when the print instruction is a monochrome print, i.e. when the number of colors of developers to be ejected on the printing sheet 9 is smaller than or equal to the preset reference value, and when NO at S22, only one monochromatic toner image is transferred on the printing sheet 9. Thus, it is not necessary to raise the temperature of the film 51 relative to the case of the color print. In this case, the controller 70 does not execute the electric current to the second heat element 57 immediately, and detects the temperature T of the film 51 by the temperature sensor 59 disposed in the vicinity of the film 51. Then, the controller 70 determines whether the detected temperature T of the film 51 is lower than the preset reference temperature To (S24).

When the temperature T of the film 51 is higher than the reference temperature To (NO at S24), the controller does not heat the second heat element 57 and executes the thermally-fixing process to the target printing sheet 9. On the other hand, when the temperature T of the film 51 is lower than the reference temperature To (YES at S24), the controller heats the second heat element 57 by the electric current to the second heat element 57 (S23). This control allows the second heat element 57 to be heated and the film 9 to be heated supplementarily when the number of colors of developers to be ejected on the printing sheet 9 is large or when the temperature rise of the film 51 is insufficient. As a result, the film 51 can be heated up to the fixable temperature quickly.

When the thermally-fixing process is completed, the controller 70 stops the electric current to the first heat element 52. If the controller 70 executes the electric current to the second heat element 57 when the thermally-fixing process is completed, the controller 70 also stops the electric current to the second heat element 57.

The shape and configuration details of the fixing device may be different from the shape and configuration as shown in the figures of the present application. Each element appeared in the embodiments and variations may be combined appropriately, to the extent that no conflict arises.

What is claimed is:

1. A fixing device comprising:

a film having a cylindrical shape extending in a first direction;

a first heat element disposed inside a loop of the film and extending in the first direction;

a second heat element different from the first heat element;

a nip member extending in the first direction between an inner circumferential surface of the film and the first heat element and configured to contact the inner circumferential surface of the film;

a reflection member disposed inside the loop of the film and extending in the first direction, the reflection member being configured to surround the first heat element with the nip member and reflect radiant heat from the first heat element to the nip member;

a pressing member disposed outside the loop of the film and configured to press the film toward the nip member; and a supporting member disposed inside the loop of the film and extending in the first direction, the supporting member being configured to cover the reflection member and support the nip member, the supporting member including:

a first plate portion extending along the first direction and facing the nip member via the first heat element in a second direction different from the first direction; and a second plate portion and a third plate portion extending along the first direction and facing each other via the first heat element in a third direction different from the first direction and the second direction, wherein the second heat element is disposed in at least one of the second plate portion and the third plate portion.

2. The fixing device according to claim 1, wherein the second heat element is disposed in an end portion, closer to the nip member, of one of the second plate portion and the third plate portion.

3. The fixing device according to claim 1, wherein one end portion of the nip member bends along the inner circumferential surface of the film, and wherein the second heat element is disposed in one of the second plate portion and the third plate portion, which is closer to the one end portion of the nip member.

4. A fixing device comprising:

a film having a cylindrical shape extending in a first direction;

a first heat element disposed inside a loop of the film and extending in the first direction;

a second heat element different from the first heat element;

a nip member extending in the first direction between an inner circumferential surface of the film and the first heat element and configured to contact the inner circumferential surface of the film;

a reflection member disposed inside the loop of the film and extending in the first direction, the reflection member being configured to surround the first heat element with the nip member and reflect radiant heat from the first heat element to the nip member;

a pressing member disposed outside the loop of the film and configured to press the film toward the nip member; and a supporting member disposed inside the loop of the film and extending in the first direction, the supporting member being configured to cover the reflection member and support the nip member, the supporting member including:

a first plate portion extending along the first direction and facing the nip member via the first heat element in a second direction different from the first direction; and a second plate portion and a third plate portion extending along the first direction and facing each other via the first heat element in a third direction different from the first direction and the second direction, wherein the second heat element is disposed in at least one of the second plate portion, the third plate portion, one end portion of the nip member in the third direction, and another end portion of the nip member in the third direction, and wherein the second heat element is disposed on an inner surface, which is opposite to an outer surface facing the film, of the nip member, in one of the one end portion and the other end portion of the nip member.

5. The fixing device according to claim 1, wherein the nip member includes a nip surface, the nip surface and the pressing member being configured to sandwich the film therebetween, wherein one end portion of the nip member includes an extending portion extending from the nip surface along the inner circumferential surface of the film, and wherein the second heat element is disposed in one of the second plate portion and the third plate portion, which is closer to the extending portion, or disposed in the extending portion.

6. The fixing device according to claim 5, further comprising a guide member configured to contact the inner circumferential surface of the film and including a guide surface configured to guide the film to the nip surface, wherein the film is closest to the second heat element between the guide surface and the nip surface.

7. The fixing device according to claim 5, wherein the second heat element is positioned between the extending portion and one of the second plate portion and the third plate portion, which is closer to the extending portion.

8. The fixing device according to claim 1, wherein the second heat element is a plate-like heater.

9. The fixing device according to claim 8, wherein the second heat element is a ceramic heater.

10. The fixing device according to claim 1, further comprising a temperature sensor configured to detect a temperature of the film and a controller configured to control the second heat element, wherein the controller is configured to heat the second heat element when the detected temperature is smaller than a preset reference value.

11. The fixing device according to claim 1, further comprising a controller configured to control the second heat element, wherein the controller is configured to acquire information indicating a number of colors of developers to be used in printing, and to heat the second heat element when the number of colors is larger than a preset reference value.

12. The fixing device according to claim 1, further comprising a partition configured to partition the first heat element and the second heat element.

13. The fixing device according to claim 12, wherein the partition is at least one of the reflection member and the supporting member.

14. The fixing device according to claim 1, wherein a sheet is fed in a sheet feed direction passing between the film and the pressing member, and wherein the second heat element is disposed upstream of the first heat element in the sheet feed direction.

15. The fixing device according to claim 9, wherein an amount of the radiant heat from the first heat element is larger than an amount of the radiant heat from the second heat element.

16. The fixing device according to claim 1, wherein the first heat element is a halogen lamp.

17. The fixing device according to claim 1, wherein when an electric current to the second heat element is carried, heat is conducted from the second heat element to the film via the supporting member, the reflection member, and the nip member.

* * * * *